US010179339B2

(12) United States Patent
Archer et al.

(10) Patent No.: US 10,179,339 B2
(45) Date of Patent: Jan. 15, 2019

(54) BUBBLER ASSEMBLY

(71) Applicant: ZODIAC POOL SYSTEMS LLC, Vista, CA (US)

(72) Inventors: Roy Archer, Oakland, FL (US); Joseph A. Palma, Lakeworth, FL (US)

(73) Assignee: Zodiac Pool Systems LLC, Vista, CA (US)

( * ) Notice: Subject to any disclaimer, the term of this patent is extended or adjusted under 35 U.S.C. 154(b) by 0 days.

(21) Appl. No.: 15/579,519

(22) PCT Filed: Jun. 3, 2016

(86) PCT No.: PCT/US2016/035890

§ 371 (c)(1),
(2) Date: Dec. 4, 2017

(87) PCT Pub. No.: WO2016/197045

PCT Pub. Date: Dec. 8, 2016

(65) Prior Publication Data

US 2018/0154389 A1 Jun. 7, 2018

Related U.S. Application Data

(60) Provisional application No. 62/171,734, filed on Jun. 5, 2015.

(51) Int. Cl.
*B05B 17/08* (2006.01)
*B05B 15/70* (2018.01)
(Continued)

(52) U.S. Cl.
CPC ..... *B05B 17/08* (2013.01); *A61H 33/0087* (2013.01); *A61H 33/0091* (2013.01);
(Continued)

(58) Field of Classification Search
CPC ..... B05B 17/08; B05B 15/70; A61H 33/0091; A61H 2201/0188; E04H 4/12; E04H 4/148
(Continued)

(56) References Cited

U.S. PATENT DOCUMENTS 4,212,088 A * 7/1980 Goettl ..... B05B 15/70 4/490
6,644,561 B1 * 11/2003 Daane ..... B05B 15/70 239/18
(Continued)

FOREIGN PATENT DOCUMENTS

AU 3138671 1/1973

OTHER PUBLICATIONS

International Patent Application No. PCT/US2016/035890, International Search Report and Written Opinion, dated Aug. 30, 2016, 12 pages.

*Primary Examiner* — Benjamin R Shaw
(74) *Attorney, Agent, or Firm* — Kilpatrick Townsend & Stockton LLP; Dean W. Russell; Renae Bailey Wainwright

(57) ABSTRACT

A bubbler assembly including a pipe that telescopes relative to a surface of a pool or spa such that an exit opening of the bubbler is closer to the water surface than is conventionally possible. When in the initial position, a first end of the telescoping pipe is flush or substantially flush with the surface of the pool or the spa. When in the extended position, the first end of the telescoping pipe is adjacent the water surface, which is spaced apart from the surface of the pool or spa. By transferring the exit opening of the bubbler to a location adjacent the water surface, the plume need travel only a small distance through the main body of water before penetrating the water surface.

20 Claims, 5 Drawing Sheets

(51) Int. Cl.
*E04H 4/12* (2006.01)
*E04H 4/14* (2006.01)
*A61H 33/00* (2006.01)

(52) U.S. Cl.
CPC ..... *B05B 15/70* (2018.02); *E04H 4/12* (2013.01); *E04H 4/148* (2013.01); *A61H 2201/0161* (2013.01); *A61H 2201/0188* (2013.01)

(58) Field of Classification Search
USPC ..... 4/496
See application file for complete search history.

(56) References Cited

U.S. PATENT DOCUMENTS

| | | | | |
|---|---|---|---|---|
| 8,590,071 | B1 * | 11/2013 | Lopez | E04H 4/169 239/204 |
| 2005/0155144 | A1 * | 7/2005 | McDonald | A61H 9/00 4/507 |
| 2006/0101570 | A1 * | 5/2006 | Kunkel | B05B 17/08 4/507 |
| 2008/0094821 | A1 * | 4/2008 | Vogtner | B05B 17/085 362/101 |
| 2009/0154163 | A1 * | 6/2009 | Wesselmeier | B05B 17/08 362/253 |
| 2009/0250528 | A1 * | 10/2009 | Schnuckle | B05B 17/08 239/18 |
| 2015/0266038 | A1 * | 9/2015 | Shelman | B05B 15/70 239/203 |

* cited by examiner

BUBBLER ASSEMBLY

CROSS-REFERENCE TO RELATED APPLICATION

This application claims the benefit of U.S. Provisional Application Ser. No. 62/171,734 filed Jun. 5, 2015 and titled "Water Feature Principally For Swimming Pools or Spas," the entire contents of which are incorporated herein by this reference.

FIELD OF THE INVENTION

This invention relates to water features and more particularly, but not exclusively, to water fountains, or "bubblers," principally (although not necessarily exclusively) for swimming pools or spas.

BACKGROUND OF THE INVENTION

Conventional bubblers function as illuminated or non-illuminated fountains within pools or spas. Mounted flush with a surface of a pool or spa, a typical bubbler includes a central exit opening circumferentially surrounded by a lens. Included as part of the lens is an electrically-powered source of illumination. The bubbler may be plumbed into the water-recirculation system of the pool or spa downstream of a pump so as to receive pressurized water. The pressurized water is forced through the central exit opening of the bubbler to produce a plume, with the water of the plume being illuminated by the illumination source.

Because bubblers typically are mounted flush with various pool or spa surfaces, and the exit openings of the bubblers are fixed flush with lenses that are also mounted flush with the pool or spa surfaces, the exit openings of the bubblers are remote from the water surfaces of the associated pools or spas. Consequently, a plume exiting such a bubbler must travel a material distance through the main body of water of the pool or spa before penetrating the water surface to provide a fountain effect. This process can cause the plume to rotate, be erratic, or otherwise be undesirably affected aesthetically or physically.

SUMMARY

The term embodiment and like terms are intended to refer broadly to all of the subject matter of this disclosure. Statements containing these terms should be understood not to limit the subject matter described herein. This summary is a high-level overview of various aspects of the disclosure and introduces some of the concepts that are further described in the Detailed Description section below. This summary is not intended to identify key or essential features, nor is it intended to be used in isolation.

Disclosed herein is a bubbler assembly with an exit opening that can be selectively positioned closer to the water surface than is conventionally possible. By transferring the exit opening to a location adjacent the water surface, the plume of water need travel only a small distance through the main body of water before penetrating the water surface. Accordingly, the main body of water has little or no adverse impact on the characteristics of the plume exiting the bubbler assembly.

BRIEF DESCRIPTION OF THE FIGURES

The specification makes reference to the following appended figures, in which use of like reference numerals in different figures is intended to illustrate like or analogous components.

DETAILED DESCRIPTION

FIGS. 1-5 illustrate a non-limiting example of a bubbler assembly 10 having a telescoping pipe 12 that transfers the exit opening of the plume of the bubbler assembly to a location adjacent the water surface or a pool or spa. In particular, first end 14 of the telescoping pipe 12 provides an exit opening 18 for the plume that is selectively positioned proximate the water surface. Telescoping pipe 12 is coupled with another pipe (not pictured) that is part of a water-recirculation system of the pool or spa and that is downstream of a pump of the water-recirculation system. In this way, telescoping pipe 12 can receive pressurized water from the pump of the water-recirculation system.

Figure 1:
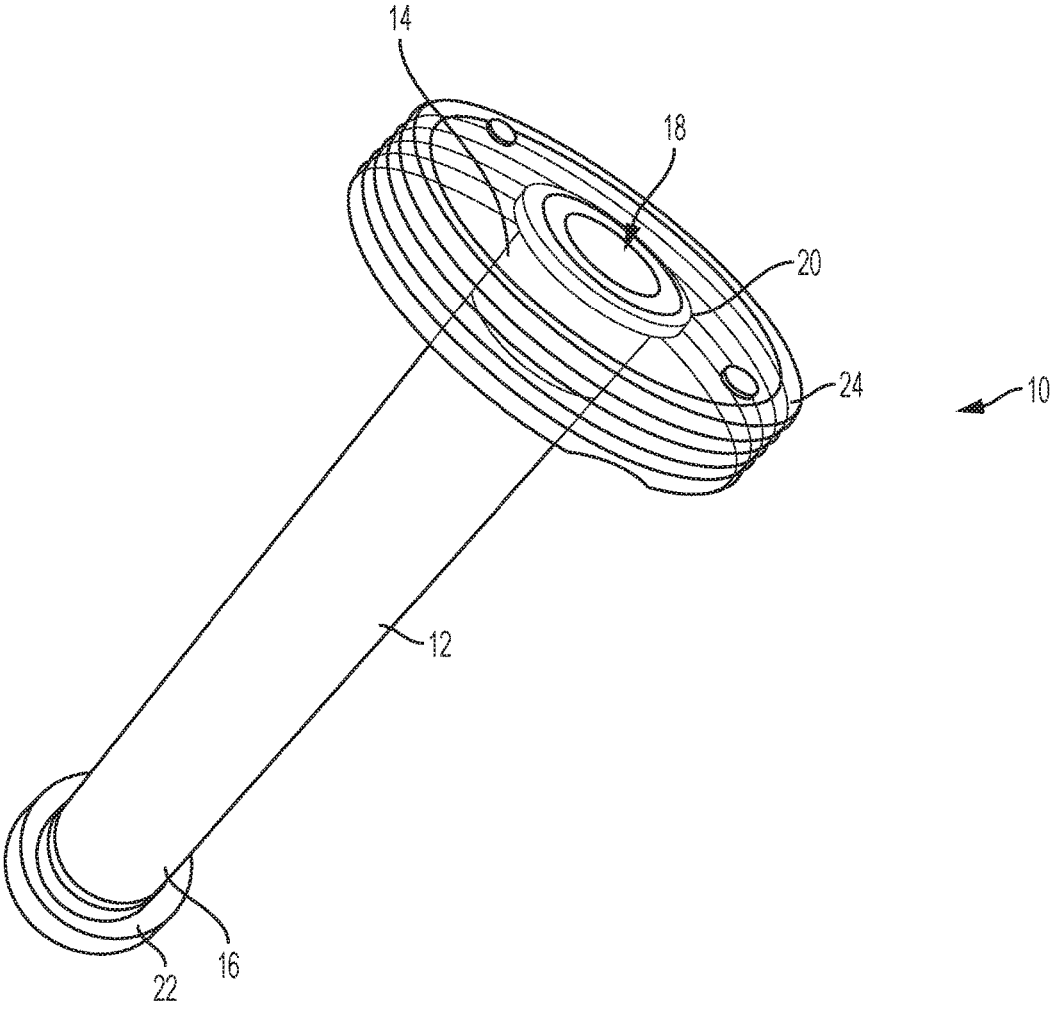
FIG. 1 illustrates an exemplary bubbler assembly in an initial position.
Figure 3:
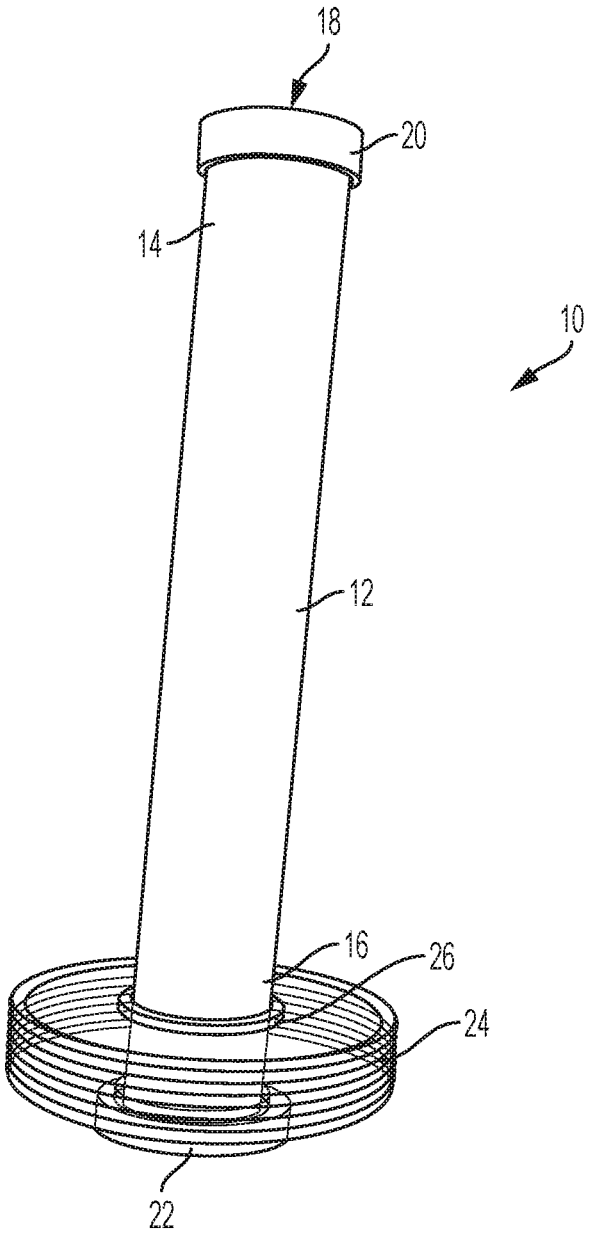
FIG. 3 illustrates the bubbler assembly of FIG. 1 in an extended position.

Telescoping pipe 12 telescopes relative to lens 24, which is mounted on the pool or spa surface and may include an electrically-powered source of illumination. As illustrated in FIG. 1, the exit opening 18 of the telescoping pipe 12 is circumferentially surrounded by the lens 24. Telescoping pipe 12 also telescopes with respect to the pipe with which it is coupled. As shown in FIG. 3, the diameter of telescoping pipe 12 is slightly smaller than the diameter of an inner ring 26 of the lens 24 so that telescoping pipe 12 is received within the inner ring 26 so as to not obstruct light that is emitted from lens 24. In some examples, telescoping pipe 12 is slightly smaller than the diameter of the pipe with which it is coupled so that telescoping pipe 12 is free to telescope within the pipe.

Prior to use, as shown in FIG. 1, the first end 14 of the telescoping pipe 12 may be flush or substantially flush with a portion of the lens 24. In the illustrated example, a lip 20 of the first end 14 of the telescoping pipe 12 is substantially flush with a top surface of the lens 24. As illustrated in FIG. 1, the second end 16 of the telescoping pipe 12 opposite the first end 14 is positioned below the lens 24 such that the first end 14 of the pipe is positioned between the water surface of the pool or spa and the second end 16 of the pipe. As mentioned above, the second end 16 of the telescoping pipe 12 is received within the pipe with which it is coupled. In use, at least some of the pressurized water moving through the water-recirculation system flows through the pipe coupled with telescoping pipe 12 and causes the telescoping pipe 12 to extend outward from the lens 24, thus moving the first end 14 of the telescoping pipe 12 outward from the lens 24 toward the water surface. More specifically, at least some of the pressurized water moving through the pipe coupled with the telescoping pipe 12 pushes against the lower surface of the telescoping pipe 12 and causes the telescoping pipe 12 to move upwards toward the water surface. The pressurized water then exits through the exit opening 18 of the telescoping pipe 12 to produce a plume, with the water of the plume being illuminated by the light emitted from the lens 24.

Figure 2:
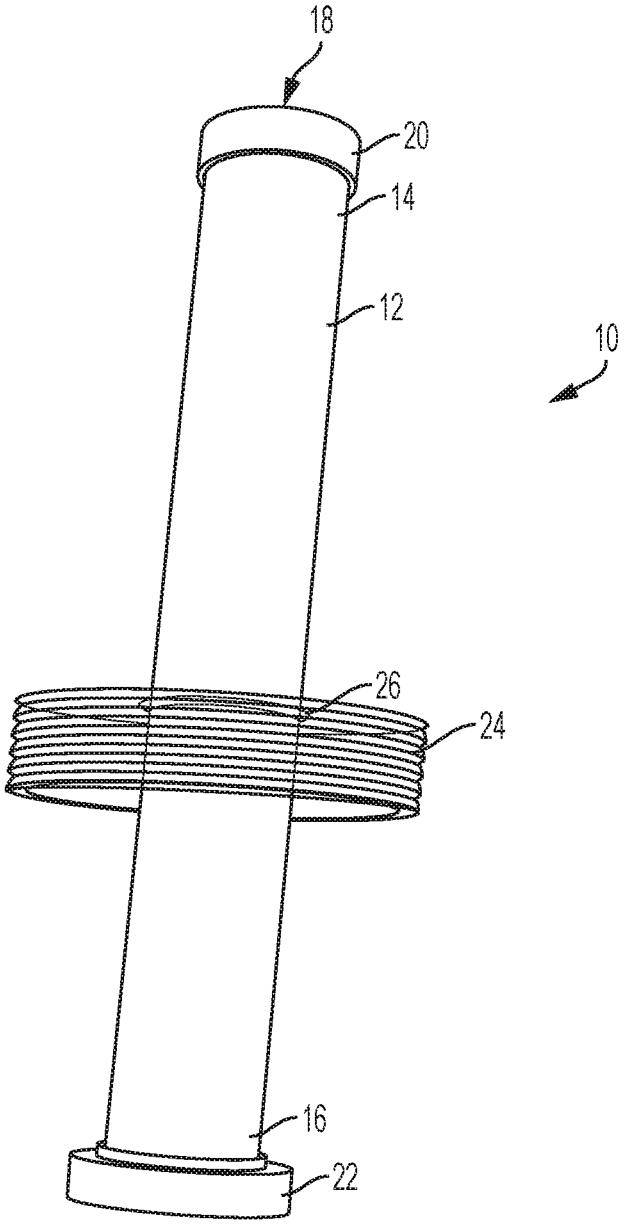
FIG. 2 illustrates the bubbler assembly of FIG. 1 in an intermediate position.

FIG. 2 illustrates the telescoping pipe 12 in an intermediate position as the first end 14 moves away from the lens 24 toward the water surface. FIG. 3 illustrates the telescoping pipe 12 in an extended position where the telescoping pipe 12 extends outwardly with respect to the surface of the pool or spa. The telescoping pipe 12 may have a length such that, in the extended position, the exit opening 18 is adjacent the water surface. As one non-limiting example, the telescoping pipe may be approximately 7-10 inches, or any other suitable length depending on the distance between the water surface and the surface of the pool or spa on which the bubbler assembly 10 is mounted. In the extended position, the exit opening 18 of the telescoping pipe 12 may be slightly below, flush with, or slightly above the surface of the water.

Figure 4:
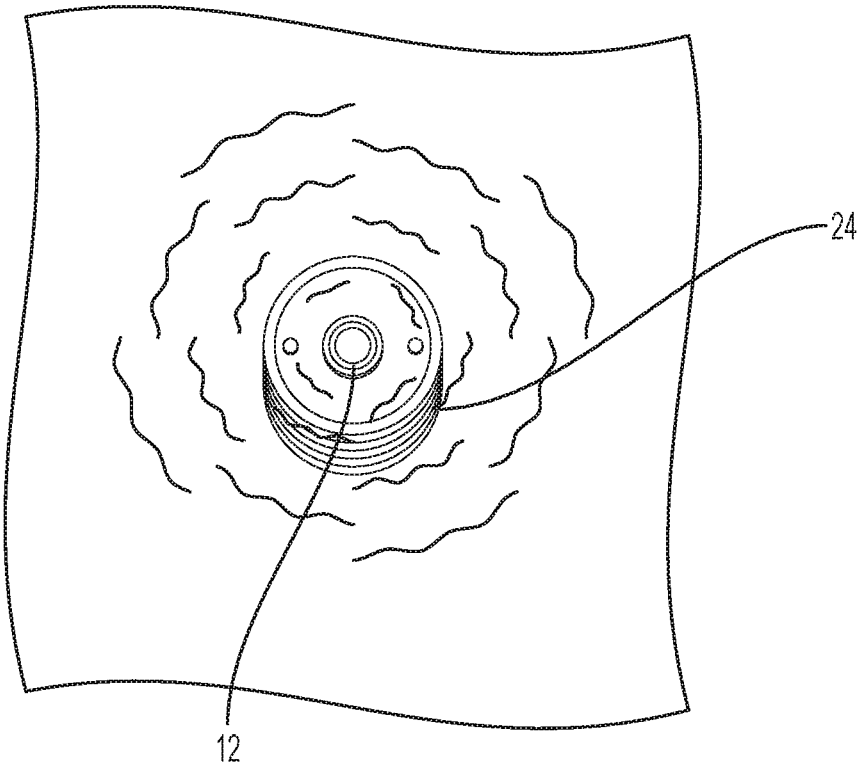
FIG. 4 illustrates the bubbler assembly of FIG. 1 mounted on a pool or spa surface and in the initial position.
Figure 5:
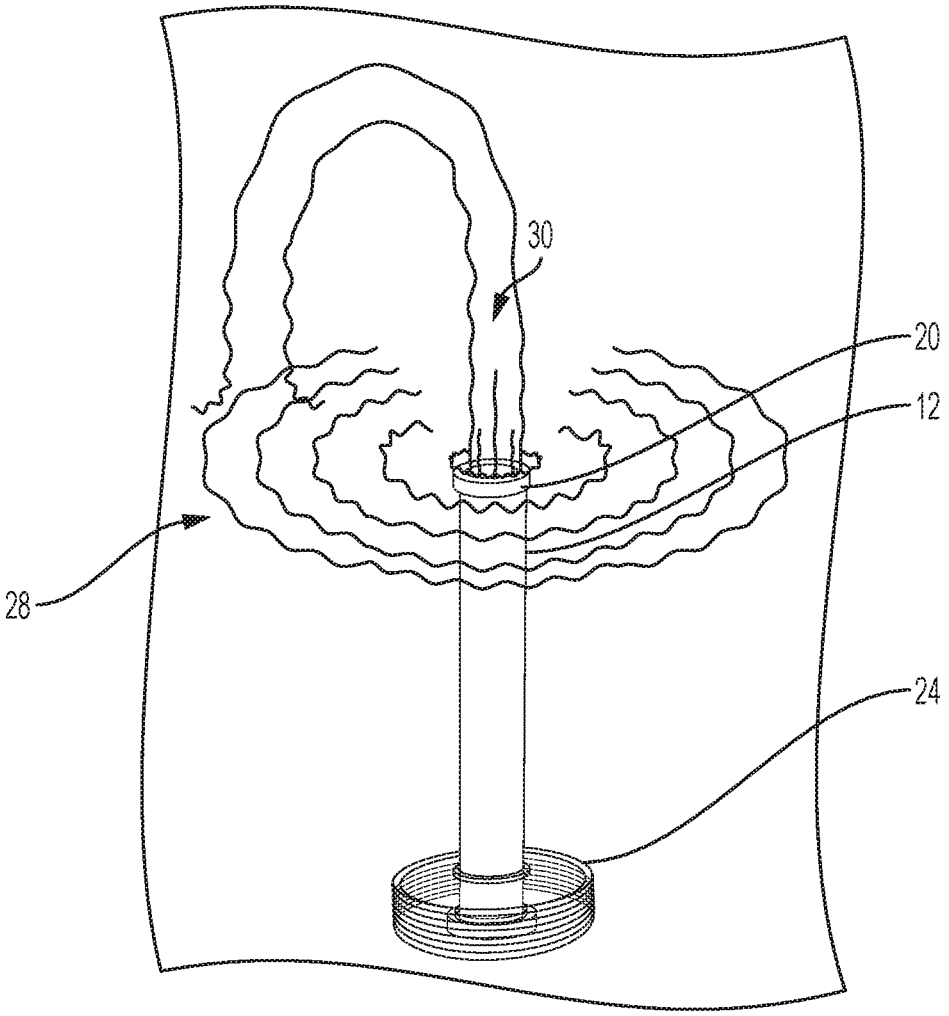
FIG. 5 illustrates the bubbler assembly of FIG. 1 mounted on a pool or spa surface and in the extended position.

As illustrated in FIG. 5, the movement of the first end 14 of the telescoping pipe 12 to a position adjacent the water surface 28 (i.e., the extended position of the telescoping pipe 12) results in the plume 30 commencing adjacent the water surface 28 as the plume exits the exit opening 18. The exit opening 18 may include more than one opening and otherwise be configured to produce a plume of water 30 having the desired characteristics including the desired aesthetics, dimensions and/or flow properties. In some cases, the exit opening 18 includes a chamfer to allow the exiting water to flow without creating a resonation or disturbance in the plume 30. FIG. 4 illustrates the bubbler assembly 10 positioned relative to the pool or spa surface when the pump is turned off and the telescoping pipe 12 is in its initial position.

When the fountain effect of the plume 30 is no longer needed, either the corresponding pump may be disabled or the pressurized water from the pump may be diverted away from the bubbler. In either instance, no pressure will exist to sustain the outward movement of the telescoping pipe 12 relative to the surface of the pool or spa. Gravity causes the telescoping pipe 12 to move downward and retract to its initial position, where the first end 14 of the telescoping pipe 12 is generally flush with the lens 24. In some cases, the second end 16 of the telescoping pipe 12 includes a weight 22 that biases the first end 14 of the telescoping pipe 12 to retract to its initial position in the absence of the pressurized water. The weight 22 can be configured so it does not counteract the forces of the pressurized water that cause the telescoping pipe 12 to move into its extended position, while still biasing the telescoping pipe 12 into its initial position when not subjected to the pressurized water.

The weight 22 also can be shaped and dimensioned to serve as a stop. Specifically, the diameter of the weight 22 can be slightly larger than the diameter of the inner ring 26 of the lens 24, thus preventing the second end 16 of the telescoping pipe 12 from extending beyond the lens 24 and disengaging from the lens 24 as the telescoping pipe 12 moves into its extended position. With reference to FIG. 3, when the telescoping pipe 12 is in the extended position, the weight 22 abuts the bottom surface of the lens 24. The weight 22 can be an integral part of the telescoping pipe 12 or a separate component that is coupled with the second end 16 of the telescoping pipe 12. In some cases, weight 22 is plastic, although any suitable material may be used.

In some aspects, the first end 14 of the telescoping pipe 12 includes a lip 20. Lip 20 is configured to interface with the inner ring 26 of the lens 24 and serve as a stop. The diameter of lip 20 is slightly larger than the diameter of the inner ring 26. In this way, lip 20 prevents the first end 14 of the telescoping pipe 12 from retracting beyond the lens 24 and disengaging from the lens 24 as the telescoping pipe 12 moves into its initial position. As noted above, lip 20 may be configured and dimensioned so the exit opening 18 of the telescoping pipe 12 is flush or substantially flush with the surface of the pool or spa when the telescoping pipe 12 is in the initial position as shown in FIG. 1. The lip 20 can be an integral part of the telescoping pipe 12 or a separate component that is coupled with the first end 14 of the telescoping pipe 12. In some cases, lip 20 is plastic, although any suitable material may be used.

Telescoping pipe 12 can be made of any suitable material, such as polyvinyl chloride (PVC) or other plastic. In some cases, the telescoping pipe 12 is made of a flexible material, such as but not limited to flexible PVC, which helps prevent damage to the telescoping pipe 12 and/or a person or object that encounters the telescoping pipe 12 when it extends beyond the surface of the lens 24 (e.g., when the telescoping pipe 12 is in the extended position or an intermediate position between the extended position and the initial position).

In some cases, the bubbler assembly 10 does not include a lens and may instead telescope within an aperture of the pool or spa surface. In examples where the bubbler assembly 10 does not include a lens, the aperture may include a positive or negative surface feature (such as a circular stop feature) that interfaces with the lip 20 and/or the weight 22 to prevent the telescoping pipe 12 from extending beyond its extended position or retracting beyond its initial position.

The foregoing, together with the accompanying photographs, is provided for purposes of illustrating, explaining, and describing embodiments of the present invention. Modifications and adaptations to these embodiments will be apparent to those skilled in the art and may be made without departing from the scope or spirit of the invention.

The invention claimed is:

1. A bubbler assembly for a pool or spa comprising:

a lens mounted flush or generally flush with a surface of the pool or spa, the lens comprising an inner ring; and a telescoping pipe coupled with the lens and configured to telescope within the inner ring of the lens between an initial position and an extended position, the telescoping pipe comprising a first end and a second end opposite the first end, wherein:

in the initial position, (i) an exit opening of the first end of the telescoping pipe is flush or generally flush with the lens and (ii) the second end of the telescoping pipe is beneath the lens such that the first end of the telescoping pipe is positioned between the second end of the telescoping pipe and a surface of the water of the pool or spa; and in the extended position, (i) the exit opening of the first end of the telescoping pipe is adjacent the surface of the water of the pool or spa such that a plume of water exits the exit opening adjacent the surface of the water of the pool or spa and (ii) the second end of the telescoping pipe is flush or generally flush with the surface of the pool or spa, wherein the lens comprises an electrically-powered source of illumination.

2. The bubbler assembly of claim 1, wherein a diameter of the telescoping pipe is smaller than a diameter of the inner ring of the lens.

3. The bubbler assembly of claim 1, wherein the first end of the telescoping pipe comprises a lip with a diameter that is larger than a diameter of the inner ring of the lens such that the lip prevents the telescoping pipe from disengaging with the lens as the telescoping pipe moves into the initial position.

4. The bubbler assembly of claim 1, wherein the second end of the telescoping pipe comprises a weight with a diameter that is larger than a diameter of the inner ring of the lens to prevent the telescoping pipe from disengaging with the lens as the telescoping pipe moves into the extended position.

5. The bubbler assembly of claim 1, wherein the telescoping pipe is fluidly coupled with a water-recirculation system and wherein pressurized water from the water-recirculation system causes the telescoping pipe to move from its initial position into its extended position.

6. The bubbler assembly of claim 5, wherein the second end of the telescoping pipe comprises a weight that biases the telescoping pipe from the extended position into the initial position when the pressurized water is not acting on the telescoping pipe.

7. The bubbler assembly of claim 5, wherein the bubbler assembly is configured so that the pressurized water pushes against a lower surface of the second end of the telescoping pipe.

8. The bubbler assembly of claim 1, wherein the telescoping pipe is flexible.

9. A bubbler assembly comprising a pipe configured to telescope with respect to an aperture in a surface of a pool or spa, the pipe comprising:

a first end that is positioned (i) flush or generally flush with the surface of the pool or spa when the pipe is in an initial position and (ii) adjacent a surface of water of the pool or spa when the pipe is in an extended position, wherein the surface of the water of the pool or spa is spaced apart from the surface of the pool or spa and wherein at least part of the pipe is positioned within the water of the pool or spa when the pipe is in the extended position; and a second end that is positioned (i) below the surface of the pool or spa in the initial position and (ii) flush or generally flush with the surface of the pool or spa in the extended position, wherein the pipe is coupled to a lens that comprises an electrically-powered source of illumination.

10. The bubbler assembly of claim 9, wherein the first end of the pipe comprises a lip that prevents the first end of the pipe from retracting beneath the surface of the pool or spa as the pipe moves from its extended position to its initial position.

11. The bubbler assembly of claim 10, wherein a diameter of the lip is larger than a diameter of the aperture of the surface of the pool or spa.

12. The bubbler assembly of claim 9, wherein the second end comprises a stop feature that prevents the second end of the pipe from extending beyond the surface of the pool or spa as the pipe moves from its initial position to its extended position.

13. The bubbler assembly of claim 12, wherein a diameter of the stop feature is larger than a diameter of the aperture of the surface of the pool or spa.

14. The bubbler assembly of claim 9, wherein the aperture includes a stop feature that prevents the pipe from disconnecting with the aperture as the pipe moves between its initial position and its extended position.

15. The bubbler assembly of claim 14, wherein the stop feature is a circular disc.

16. The bubbler assembly of claim 9, wherein the pipe is coupled with a water-recirculation system such that pressurized water of the water-recirculation system acts on the second end of the pipe to move the pipe from its initial position to its extended position.

17. The bubbler assembly of claim 16, wherein the second end of the pipe comprises a weight that biases the pipe from its extended position to its initial position when the pressurized water is not acting on the pipe.

18. The bubbler assembly of claim 17, wherein the weight prevents the second end of the pipe from extending beyond the surface of the pool or spa as the pipe moves from its initial position to its extended position.

19. The bubbler assembly of claim 9, wherein:

the first end of the pipe is flush or generally flush with the lens when the pipe is in the initial position; and the second end of the pipe is beneath the lens in the initial position.

20. The bubbler assembly of claim 9, wherein:

the first end of the pipe is positioned between the second end of the pipe and the surface of the water of the pool or spa when the pipe is in the initial position.

* * * * *